US008547016B2

(12) United States Patent
Matsuura

(10) Patent No.: US 8,547,016 B2
(45) Date of Patent: Oct. 1, 2013

(54) ELECTRIC DISCHARGE LAMP UNIT

(75) Inventor: Satoshi Matsuura, Nagoya (JP)

(73) Assignee: Denso Corporation, Kariya (JP)

( * ) Notice: Subject to any disclaimer, the term of this patent is extended or adjusted under 35 U.S.C. 154(b) by 348 days.

(21) Appl. No.: 12/930,343

(22) Filed: Jan. 4, 2011

(65) Prior Publication Data

US 2011/0163667 A1 Jul. 7, 2011

(30) Foreign Application Priority Data

Jan. 6, 2010 (JP) ..... 2010-001234

(51) Int. Cl.
*H01J 13/46* (2006.01)

(52) U.S. Cl.
USPC ..... 315/50

(58) Field of Classification Search
USPC ..... 315/32, 50, 76, 77, 80, 82, 177, 291, 315/307
See application file for complete search history.

(56) References Cited

U.S. PATENT DOCUMENTS 5,597,232 A * 1/1997 Ohashi et al. ..... 362/265
5,607,228 A * 3/1997 Ozaki et al. ..... 362/263
5,838,109 A * 11/1998 Kobayashi et al. ..... 315/58
5,906,428 A * 5/1999 Hori et al. ..... 362/265
6,066,921 A * 5/2000 Nakamura et al. ..... 315/71
6,710,545 B2 * 3/2004 Yamaguchi et al. ..... 315/82
6,856,227 B2 * 2/2005 Ushio et al. ..... 336/198
2003/0006706 A1 1/2003 Yamaguchi et al.

FOREIGN PATENT DOCUMENTS

| | | |
|---|---|---|
| CN | 1148459 | 4/1997 |
| JP | 08-298190 | 11/1996 |
| JP | 2003-022702 | 1/2003 |
| JP | 2003-317535 | 11/2003 |
| JP | 2006-210009 | 8/2006 |
| JP | 2008-135235 | 6/2008 |

OTHER PUBLICATIONS

Office action dated Nov. 15, 2011 in corresponding JP Application No. 2010-001234.
Office action dated Mar. 26, 2013 in corresponding Chinese Application No. 2011100061478.

* cited by examiner

*Primary Examiner* — Minh D A
(74) *Attorney, Agent, or Firm* — Harness, Dickey & Pierce, PLC

(57) ABSTRACT

As an aspect of an embodiment, an electric discharge lamp unit includes a casing which houses an integrated circuit for lighting an electric discharge lamp, and a support member which supports the electric discharge lamp and is integrated with the casing. The casing is filled with filler. The center of the support member in the vertical direction is higher than the center of the casing in the vertical direction and the center of the integrated circuit in the vertical direction.

10 Claims, 4 Drawing Sheets

C-C CROSS SECTION

ELECTRIC DISCHARGE LAMP UNIT

CROSS REFERENCE TO RELATED APPLICATION

This application is based on and claims the benefit of priority from earlier Japanese Patent Application No. 2010-1234 filed Jan. 6, 2010, the description of which is incorporated herein by reference.

BACKGROUND OF THE INVENTION

1. Technical Field of the Invention

The present invention relates to an electric discharge lamp unit which supports an electric discharge lamp.

2. Related Art

An example of the electric discharge lamp unit is disclosed in JP-A-2003-022702. In this unit, a case member and a support member are integrated with each other. The case member houses a lighting circuit for lighting an electric discharge lamp. The support member supports the electric discharge lamp. Part of the case member near the support member is made of resin having low heat conductivity. Part of the case member located far from the support member is made of metal having high conductivity. According to the electric discharge lamp unit, the heat generated from the electric discharge lamp is difficult to conduct to the entire case member, thereby suppressing the increase in temperature inside the case.

In the case member of the above electric discharge lamp unit, the part near the electric discharge lamp, which is made of resin, is heated. When convective air exists inside the case member, the heat of the case member is easily moved by the convection of air, which can easily increase the temperature of the lighting circuit.

SUMMARY

An embodiment provides an electric discharge lamp unit which can suppress the increase in temperature of an integrated circuit thereof.

As an aspect of the embodiment, the electric discharge lamp unit includes a casing which houses a integrated circuit for lighting an electric discharge lamp and a support member which supports the electric discharge lamp and is integrated with the casing, wherein the casing is filled with filler, and the center of the support member in the vertical direction is higher than the center of the casing in the vertical direction and the center of the integrated circuit in the vertical direction.

DETAILED DESCRIPTION OF THE PREFERRED EMBODIMENTS

Figure 1:
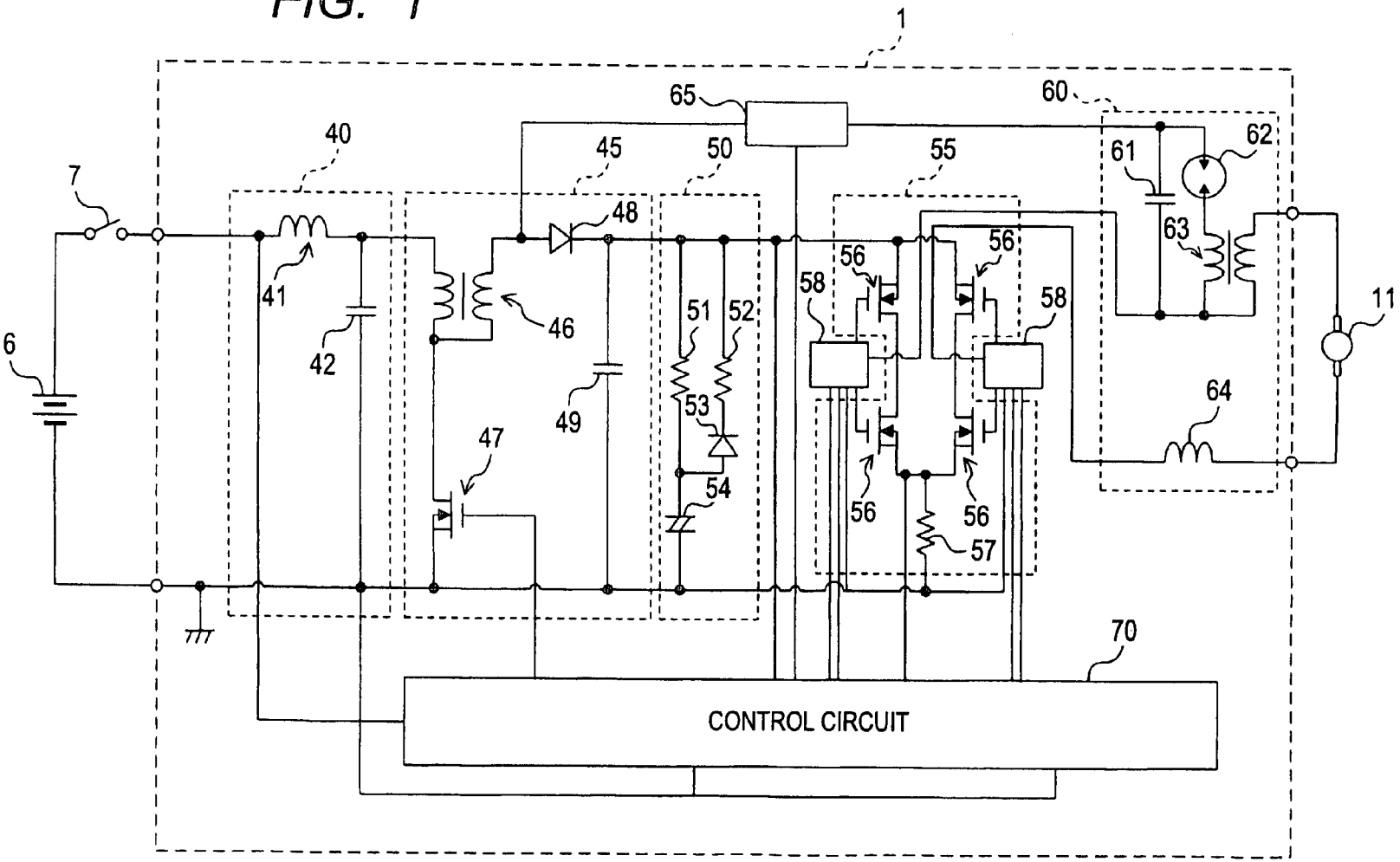
FIG. 1 is a circuit diagram showing a circuit configuration of an electric discharge lamp unit.

Hereinafter, embodiments will be described with reference to the accompanying drawings. In the embodiments set forth below, the components identical with or similar to each other are given the same reference numerals for the sake of omitting unnecessary explanation.

(Circuit Configuration of the Embodiment)

FIG. 1 is a circuit diagram showing a circuit configuration of an electric discharge lamp unit 1.

The electric discharge lamp unit 1 is installed in a vehicle such as a passenger car, and lights an electric discharge lamp (bulb) 11 which is a headlight lighting up the area in front of the vehicle. As shown FIG. 1, the electric discharge lamp unit 1 is supplied with electric power from a battery 6, which is disposed outside the unit 1, via a switch 7. When the driver turns on the switch 7, the electric discharge lamp unit 1 is supplied with electric power from the battery 6.

As shown FIG. 1, the electric discharge lamp unit 1 includes a filter circuit 40, a DC/DC converter 45, an auxiliary lighting circuit 50, an H-bridge circuit 55, a high-voltage generating circuit 60, and a control circuit 70.

The filter circuit 40 has an input coil 41 and an input capacitor 42. The filter circuit 40 is a smoothing circuit which smoothes power supply voltage obtained from the battery 6.

The DC/DC converter 45 has a DC/DC transformer 46, a power MOS transistor 47 which is a power device, a diode 48, and a capacitor 49. The DC/DC converter 45 raises the power supply voltage (e.g. 12V) to the voltage supplied to the lamp (e.g. 40V).

The auxiliary lighting circuit 50 includes two resistors 51 and 52 connected to a power-source-side terminal in parallel, a diode 53 connected to the resistor 52 in series, and a take-over capacitor 54 connected to the resistor 51 and the diode 53. The auxiliary lighting circuit 50 temporarily supplies electric power required for lighting the electric-discharge lamp 11 to the electric-discharge lamp 11. The takeover capacitor 54 has a function of storing required electric power.

The H-bridge circuit 55 includes four power transistors 56 and a resistor 57 arranged as a current sensing resistor. The H-bridge circuit 55 is controlled by a driver 58, which receives an operation signal from the control circuit 70 and performs switching between the power transistors 56. Due to the control, the output from the H-bridge circuit 55 is converted from DC to AC (rectangular wave).

The high-voltage generating circuit 60 has a high-voltage generating capacitor 61, a spark gap 62, a starter transformer 63, and a noise reduction coil 64. The high-voltage generating capacitor 61 is charged in order to supply a current to be applied to the primary coil side of the starter transformer 63. The spark gap 62 performs switching of the high-voltage generating capacitor 61 for triggering discharge.

The starter transformer 63 generates starting voltage (e.g. 25 kV) for starting the lighting of the electric discharge lamp 11. Note that the spark gap 62 is supplied with high voltage from a boosting circuit 65 which has received the operating signal from the control circuit 70, and conducts at the timing when the voltage of the spark gap 62 reaches a predetermined voltage.

The control circuit 70 includes a semiconductor device which detects the voltage of the above circuits and controls the circuit elements such as the driver 58 and the boosting circuit 65 based on the detected voltage. Note that the control circuit 70 functions as a well-known and so-called ballast in the discharge headlight.

The H-bridge circuit 55, the driver 58, the boosting circuit 65 and the like are arranged inside a ballast module 13 (integrated circuit) described later. These circuits configures a power circuit 80 (refer to FIG. 2) which generates electric power supplied to the electric discharge lamp 11. The control circuit 70, which controls the operation of the power circuit 80, is also arranged inside the ballast module 13.

(Schematic Arrangement of the Components of the Embodiment)

Figure 2:
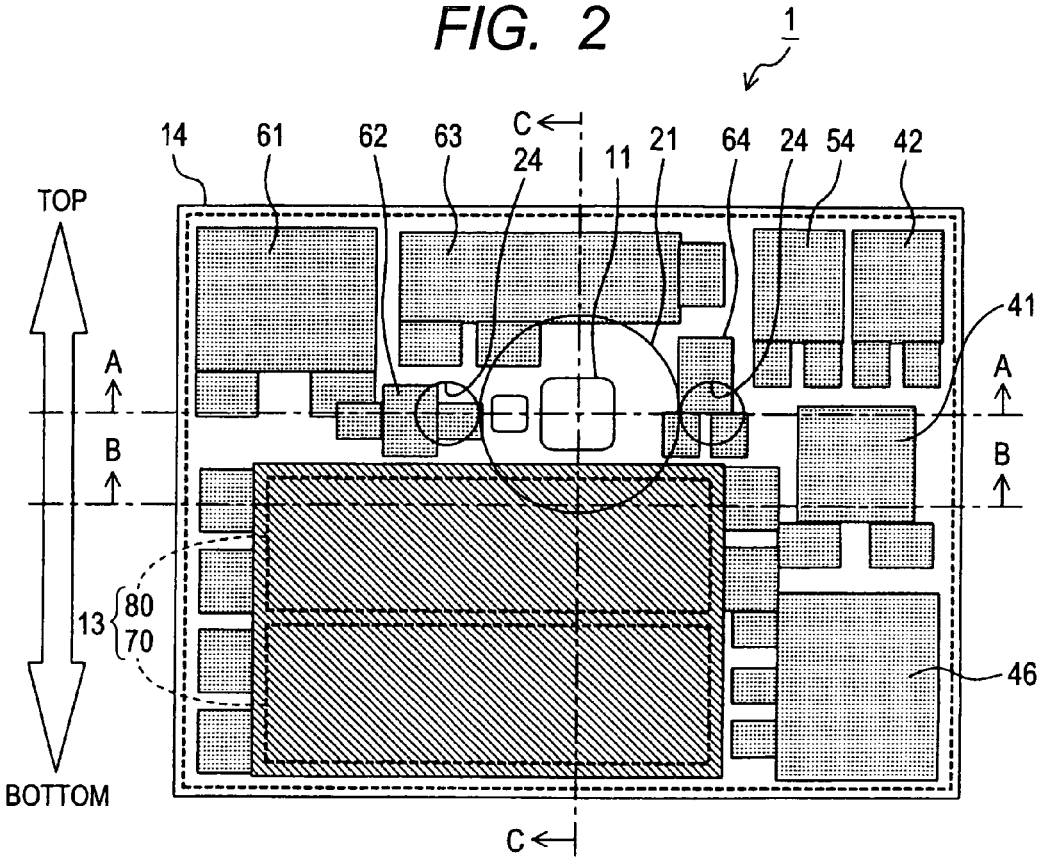
FIG. 2 is a plan view of the electric discharge lamp unit.
Figure 3:
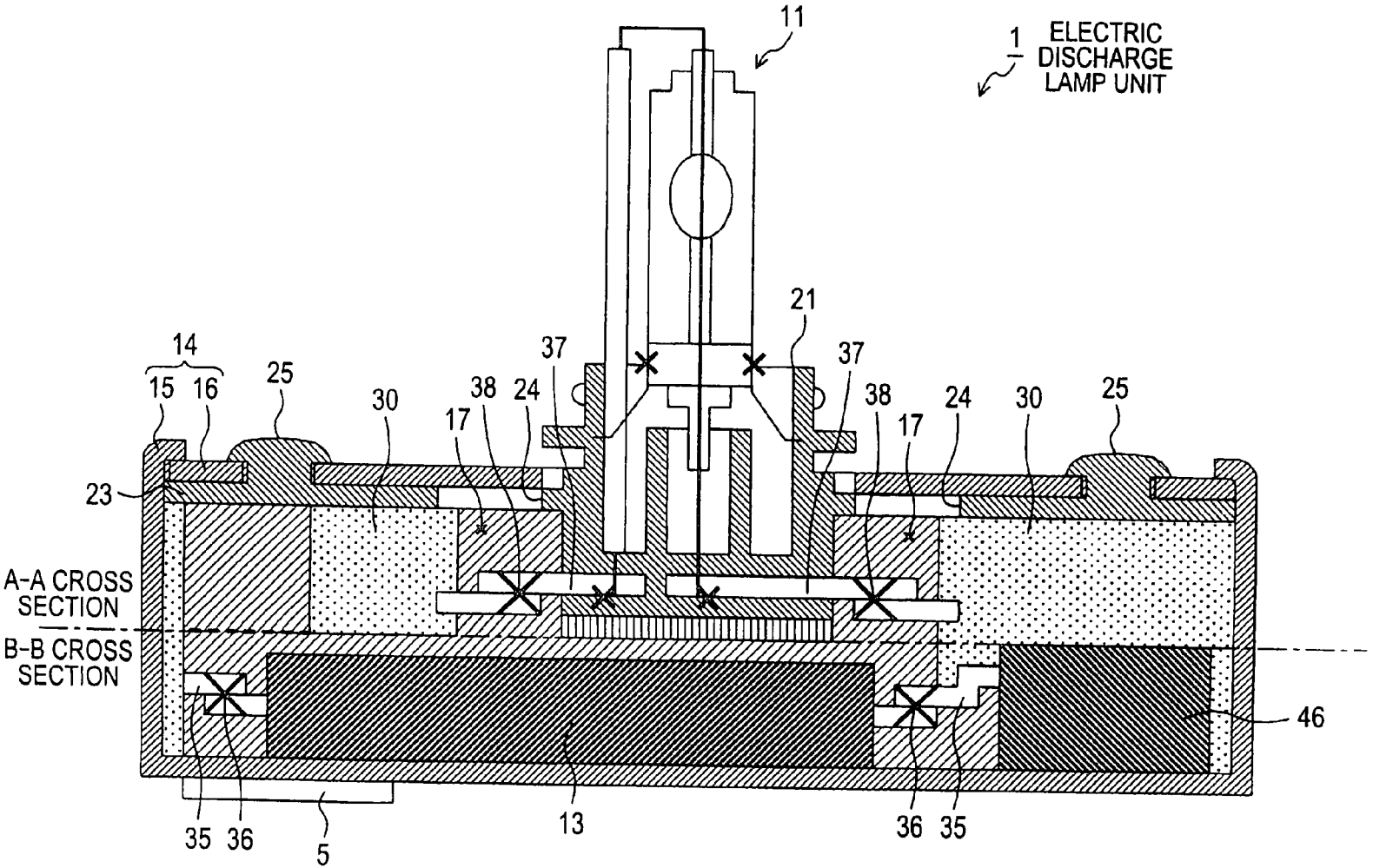
FIG. 3 is a sectional view of the electric discharge lamp unit cut in the horizontal direction.
Figure 4:
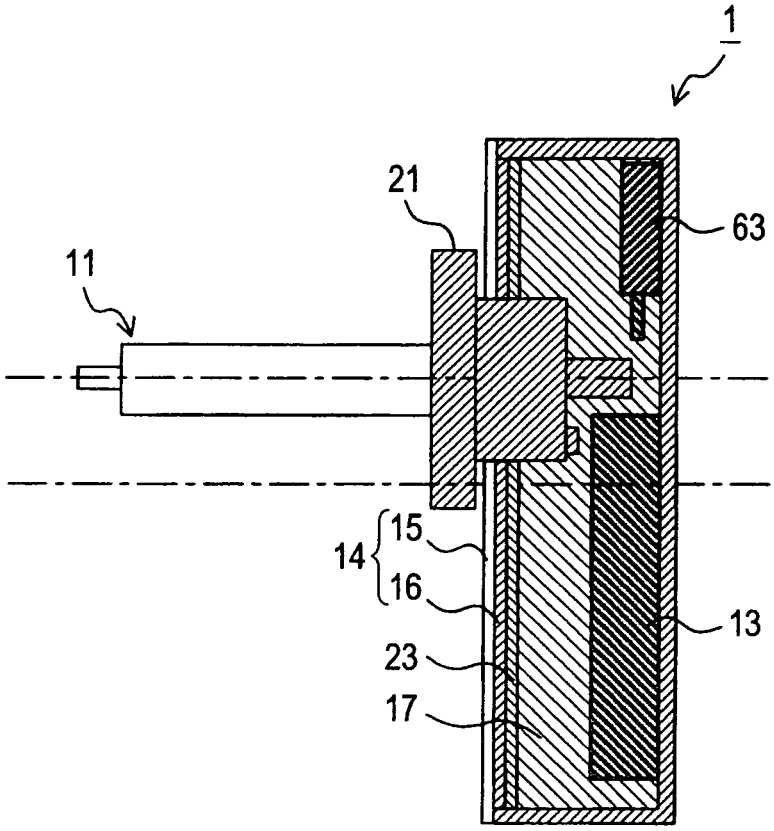
FIG. 4 is a sectional view of the electric discharge lamp unit cut in the vertical direction.

Next, an arrangement of the components in the electric discharge lamp unit 1 will be described with reference to FIGS. 2 to 4. FIG. 2 is a plan view of the electric discharge lamp unit 1. FIG. 3 is a sectional view of the electric discharge lamp unit 1 cut in the horizontal direction. FIG. 4 is a sectional view of the electric discharge lamp unit 1 cut in the vertical direction. Note that FIG. 2 shows the components as a perspective view so that the arrangement of the components can be seen. In FIG. 3, the part above the alternate long and short dash line shows a sectional view along a plane passing through a central portion of the electric-discharge lamp 11, and the part below the alternate long and short dash line shows a sectional view along a plane passing through the center of the electric-discharge lamp unit 1 in the vertical direction.

The electric discharge lamp unit 1 is configured by housing the above circuits in a case member 14 (casing) as shown in FIGS. 2 to 4. The case member 14 holds an electric discharge lamp support 21 (support member), which supports the electric discharge lamp 11, in a state where the electric discharge lamp support 21 is exposed to the outside.

The case member 14 is configured with a lid member 16 and a body member 15 which butt against each other. The lid member 16 includes a surface on the side where the electric discharge lamp support 21 supporting the electric discharge lamp 11 is exposed (upper side in FIG. 3). The body member 15 is positioned on the side of the ballast module 13 (lower side in FIG. 3) and does not include a surface on the side where the electric-discharge lamp support 21 is exposed. The body member 15 is configured by, for example, forming metal such as aluminum into a substantial rectangular parallelepiped body (exclusive of a portion corresponding to the lid). The body member 15 functions as an electromagnetic shield which prevents noise outside the case member 14 from entering the case member 14 and noise generated inside the case member 14 from leaking to the outside of the case member 14. The body member 15 also functions as a heat sink which releases heat inside the case member 14 to the outside thereof.

Meanwhile, the lid member 16 is configured with resin which has heat conductivity lower than that of metal. The lid member 16 having the configuration conducts heat poorly from the electric discharge lamp 11 into the case member 14 compared with the case where the lid member 16 is configured with metal. Note that the lid member 16 may be configured with metal such as aluminum. In this case, the lid member 16 functions as an electromagnetic shield.

A reflector (not shown) having a concave reflecting surface can be disposed between the case member 14 and the electric discharge lamp support 21. The reflector reflects the light of the electric discharge lamp 11 to the front thereof (upward in FIG. 3).

As shown in FIG. 2, inside the case member 14, the ballast module 13 and the DC/DC transformer 46 are arranged at an area near a road surface assuming that the electric discharge lamp unit 1 is installed in a vehicle. At an area far from the road surface, the input coil 41, the input capacitor 42, the high-voltage generating capacitor 61, the spark gap 62, the starter transformer 63, the noise reduction coil 64 and the like are arranged. The input coil 41 and the input capacitor 42 configure the filter circuit 40. The high-voltage generating capacitor 61 configures the high-voltage generating circuit 60.

That is, the ballast module 13 is arranged so that the center thereof in the vertical direction (up-and-down direction when installed) is positioned lower than the center (indicated by an alternate long and short dash line showing B-B cross section in FIG. 2) of the case member 14 in the up-and-down direction.

In addition, the electric discharge lamp support 21 is arranged so that the center (indicated by an alternate long and short dash line showing A-A cross section in FIG. 2) thereof in the vertical direction is positioned higher than the center of the case member 14 in the vertical direction (refer to FIGS. 2 and 4). Consequently, the center of the ballast module 13 in the vertical direction is positioned lower than the center of the electric discharge lamp support 21 in the vertical direction.

Furthermore, in the ballast module 13, the power circuit 80, which generates electric power supplied to the electric discharge lamp 11, is arranged in an area near the electric discharge lamp support 21 and on the upper side in the vertical direction. The control circuit 70 is arranged in an area far from the electric discharge lamp support 21 and on the lower side in the vertical direction.

According to the arrangement of the ballast module 13 and the arrangement of the components inside the ballast module 13, it is difficult for the heat generated by the electric discharge lamp 11 to be conducted to the ballast module 13, especially to the control circuit 70.

In addition, according to the above arrangement, as shown in FIG. 4, overlap between the electric discharge lamp support 21 and the ballast module 13 can be reduced in the horizontal direction. Consequently, the case member 14 can be thinner (the depth of the body member 15 can be small), which is effective in reducing the space in which the electric discharge lamp unit 1 is installed.

(Assembling Process and Specific Arrangement of the Components of the Embodiment)

Hereinafter, specific arrangement of the components is described while an assembling process of the electric discharge lamp unit 1 is briefly described (chiefly, refer to FIG. 3). First, the ballast module 13 and the DC/DC transformer 46 are bonded to predetermined positions of the bottom portion of the body member 15 of the case member 14. According to this arrangement, the ballast module 13 is arranged at an area in the case member 14. The area is relatively far from the electric discharge lamp support 21 and becomes relatively low temperature. The case member 14 functions as a heat sink of the ballast module 13.

Next, molded resin 30 including an insert-molded terminal (a metal configuring wiring so-called bus bar) is arranged inside the body member 15. The molded resin 30 is previously formed into a shape which does not interfere with the ballast module 13 and the DC/DC transformer 46. The molded resin 30 has a shape which is partially hollowed out so that welding operation can be performed in the welding processes described later.

Next, a first welding process is performed which is mainly for electrically connecting terminals 35 around the ballast module 13. In this process, the terminals 35 in areas (which are positioned on the lower side in FIG. 3) near the bottom portion of the body member 15 are welded through gaps of the molded resin 30, thereby forming first welded parts 36 (refer to FIG. 3).

Next, a resin cover 23 (cover member) is arranged on the molded resin 30 and on the opening side of the body member 15 (upper side in FIG. 3). The resin cover 23 is integrated with the electric discharge lamp support 21, terminals 37 connected to the electric discharge lamp support 21, and the like. The electric discharge lamp 11 is inserted into the electric discharge lamp support 21. The electric discharge lamp 11 may be detachably configured.

The resin cover 23 has two holes 24. The holes 24 are formed at the positions corresponding to the terminals 37 connected to the electric discharge lamp 11 and on the opening side of the body member 15 (areas directly above the terminals 37 in FIG. 3).

Next, the terminals 37 positioned in areas near the opening of the body member 15 (areas on the upper side in FIG. 3), such as the terminals 37 connected to the electric discharge lamp 11, are welded through the holes 24 and gaps of the molded resin 30, thereby forming second welded parts 38 (refer to FIG. 3). Then, filler 17 (hot melt) such as potting resin, which is liquefied by heating, is poured through one of the holes 24. At this time, the other of the holes 24 functions as a vent hole for discharging air from the body member 15.

When the filler 17 is poured as described above, at least part of the filler 17 is covered with the resin cover 23 on the side of the electric discharge lamp support 21, and only the filler 17 exists in an area between the first welded part 36 and the hole 24.

Note that the shape of the molded resin 30 is considered so that the body member 15 is filled with the filler 17 without gaps when the filler 17 is poured through the hole 24. According to the configuration, the filler 17 becomes solid or gelatinous when hardened, which does not generate convection.

As the filler 17, various materials of epoxy, silicon, polyamide, polyester, olefin, urethane and the like can be utilized. In addition, the filler 17 includes an additive having heat conductivity lower than that of the filler 17. Specifically, the additives include microsilica balloon filler, which includes tiny bubbles which hardly affect the convection, and ceramic filler, which includes ceramic powder having heat conductivity lower than that of resin.

The heat conductivity of the filler 17 is set so as to be lower than that of the resin cover 23 in order to conduct more heat inside the resin cover 23 than to the filler 17, thereby discharging the heat to the outside of the case member 14.

Next, a swaging process is performed in which the lid member 16 is arranged on the resin cover 23 and on the opening side of the body member 15, and portions of the body member 15 near the opening are bent to the inside of the body member 15. Then, a heat caulking process is performed in which predetermined parts of the resin cover 23 are heated to form melted portions 25, whereby the resin cover 23 and the lid member 16 are closely contacted with each other.

Thereafter, a hardening process is performed in which the filler 17 is hardened. Consequently, the assembly of the electric discharge lamp unit 1 is completed.

(Advantages of the Embodiment)

In the electric discharge lamp unit 1 described above, the inside of the case member 14 is filled with the solid or gelatinous filler 17 without gaps. According to the electric discharge lamp unit 1, convection is not generated inside the case member 14, which can prevent heat from being transferred due to the convection.

In addition, in the electric discharge lamp unit 1, the electric discharge lamp support 21 supporting the electric discharge lamp 11 is arranged so that the center of the electric discharge lamp support 21 in the vertical direction is higher than the center of the case member 14 in the vertical direction and the center of the ballast module 13 in the vertical direction. That is, the case member 14 and the ballast module 13 are arranged in areas located far from the area in which ambient temperature easily increases and which is higher than the electric discharge lamp 11.

According to the electric discharge lamp unit 1, temperature increase in the case member 14 due to the increase in the ambient temperature can be reduced. Consequently, temperature increase in the ballast module 13 due to the temperature increase in the case member 14 can also be reduced.

Furthermore, in the electric discharge lamp unit 1, the power circuit 80 and the control circuit 70 are arranged in the ballast module 13 so that the distance between the electric discharge lamp support 21 and the control circuit 70 is longer than the distance between the electric discharge lamp support 21 and the power circuit 80.

According to the electric discharge lamp unit 1 described above, the electric discharge lamp support 21 and the control circuit 70 are arranged so that the distance therebetween becomes long to the extent possible. Thereby, the heat generated by the electric discharge lamp 11 can be difficult to be conducted to the control circuit 70 via the electric discharge lamp support 21.

Furthermore, in the electric discharge lamp unit 1, the filler 17 includes an additive having heat conductivity lower than that of the filler 17.

According to the above electric discharge lamp unit 1, adding the additive to the filler 17 allows the heat conductivity of the filler 17 to be lower than that of the body of the filler 17 (i.e. resin only). Therefore, the temperature increase in the ballast module 13 due to the heat conduction via the filler 17 can be suppressed.

In addition, the electric discharge lamp unit 1 includes the resin cover 23 which covers at least part of the surface of the filler 17 on the side of the electric discharge lamp support 21. The heat conductivity of the filler 17 is set so as to be lower than that of the resin cover 23.

According to the electric discharge lamp unit 1, since the heat conductivity of the resin cover 23 is relatively high, the heat transferred to the resin cover 23 via the electric discharge lamp support 21 conducts inside the resin cover 23 and diffuses, and is easily discharged from the surface of the resin cover 23. Thereby, since the amount of heat conducted to the filler 17 can be reduced, the amount of heat conducted to the ballast module 13 can also be reduced.

Furthermore, the electric discharge lamp unit 1 includes the second welded parts 38 for joining the components, which are arranged inside the case member 14, to each other. The resin cover 23 has the holes 24 in the areas contacting the filler 17. Only the filler 17 exists in the areas between the second welded parts 38 and the holes 24.

According to the electric discharge lamp unit 1 described above, the second welded part 38, the filler 17, and the hole 24 are arranged substantially in line. Thus, when manufacturing the electric discharge lamp unit 1, the second welded part 38 can be formed by performing welding through the hole, and thereafter the filler 17 can be poured through the same hole 24. That is, the hole 24 can be utilized in both the cases of performing welding and pouring the filler 17.

Therefore, the configuration and the manufacturing process of the electric discharge lamp unit 1 can be simplified compared with a case where holes for exclusive use are formed.

(Modifications)

It will be appreciated that the present invention is not limited to the configurations described above, but any and all modifications, variations or equivalents, which may occur to those who are skilled in the art, should be considered to fall within the scope of the present invention.

In the above embodiment, the process for assembling the electric discharge lamp unit 1 is described. However, the electric discharge lamp unit 1 may be assembled by another process provided that an electric discharge lamp unit having the same functions as those of the electric discharge lamp unit 1 can be completed.

Hereinafter, aspects of the above-described embodiments will be summarized.

As an aspect of the embodiment, in the electric discharge lamp unit, a casing is filled with filler. According to the electric discharge lamp unit, convection of air is not generated inside the casing, thereby preventing heat from being transferred due to the convection of air.

In the electric discharge lamp unit, the heat generated by the electric discharge lamp is transferred to the casing via a support member, or is discharged to surroundings of the electric discharge lamp unit, which increases ambient temperature. At this time, the ambient temperature on the upper side of the electric discharge lamp increases compared with that on the lower side of the electric discharge lamp.

To solve this problem, in the electric discharge lamp unit, the support member supporting the electric discharge lamp is arranged so that the center of the support member in the vertical direction is higher than the center of the casing in the vertical direction and the center of the integrated circuit in the vertical direction. That is, the casing and the integrated circuit are arranged in areas located far from the area in which the ambient temperature easily increases and which is higher than the electric discharge lamp.

According to the electric discharge lamp unit, temperature increase in the casing due to the increase in the ambient temperature can be reduced. Consequently, temperature increase in the integrated circuit due to the temperature increase in the casing can also be reduced. Note that "vertical direction" in the above description means the up-and-down direction when the electric discharge lamp unit is used.

Comparing a power circuit and a control circuit included in the integrated circuit, the control circuit is generally affected more adversely than the power circuit by temperature change. Note that the power circuit is a circuit which generates electric power to be supplies to the electric discharge lamp supported by the support member. The control circuit is a circuit which controls the operation of the power circuit.

To solve this problem, in the electric discharge lamp unit, the power circuit and the control circuit may be arranged in the integrated circuit so that the distance between the support member and the control circuit is longer than the distance between the support member and the power circuit.

According to the electric discharge lamp unit, since the support member and the control circuit are arranged so as to be separated from each other to the extent possible, the heat generated by the electric discharge lamp becomes to be difficult to conduct to the control circuit via the support member.

In addition, in the electric discharge lamp unit, the filler may include an additive having heat conductivity lower than that of the filler.

According to the electric discharge lamp unit, adding the additive to the filler allows the heat conductivity of the filler to be lower than the heat conductivity of the body of the filler. Therefore, the temperature increase in the integrated circuit due to the heat conduction via the filler can be suppressed.

In addition, in the electric discharge lamp unit, a cover member may be included which covers at least part of a surface of the filler on the side of the support member, and heat conductivity of the filler may be set to be lower than heat conductivity of the cover member.

According to the electric discharge lamp unit, since the heat conductivity of the cover member is relatively high, the heat transferred to the cover member via the support member conducts inside the cover member and diffuses, and is easily discharged from the surface of the cover member. Thereby, since the amount of heat conducted to the filler can be reduced, the amount of heat conducted to the integrated circuit can also be reduced.

Furthermore, the electric discharge lamp unit may include a welded part for joining components, which are arranged inside the casing, to each other. The cover member may have a hole in an area contacting the filler, and only the filler may exist in an area between the welded part and the hole.

According to the electric discharge lamp unit, the welded part, the filler, and the hole are arranged substantially in line. Thus, when manufacturing the electric discharge lamp unit, the welded part can be formed by welding a terminal arranged under the hole through the hole, and thereafter the filler can be poured through the same hole. That is, the hole can be utilized in both the cases of performing welding and pouring the filler.

Therefore, the configuration and the manufacturing process of the electric discharge lamp unit can be simplified compared with a case where holes for exclusive use are formed.

What is claimed is:

1. An electric discharge lamp unit, comprising:

a casing which houses an integrated circuit for lighting an electric discharge lamp; and a support member which supports the electric discharge lamp and is integrated with the casing, wherein the casing is filled with filler, and a center of the support member in the vertical direction is higher than a center of the casing in the vertical direction and a center of the integrated circuit in the vertical direction, the integrated circuit includes:

a power circuit which generates electric power supplied to the electric discharge lamp; and a control circuit which controls the power circuit, wherein the power circuit and the control circuit are arranged in the integrated circuit so that a distance between the support member and the control circuit is longer than a distance between the support member and the power circuit, and the power circuit, the control circuit and the support member exist in the same area within the casing and are secured by a single portion of the filler.

2. The electric discharge lamp unit according to claim 1, wherein the filler includes an additive having heat conductivity lower than heat conductivity of the filler.

3. The electric discharge lamp unit according to claim 2, further comprising a cover member which covers at least part of a surface of the filler on the side of the support member, wherein the heat conductivity of the filler is lower than heat conductivity of the cover member.

4. The electric discharge lamp unit according to claim 3, further comprising a welded part for joining components, which are arranged inside the casing, to each other, wherein the cover member has a hole in an area contacting the filler, and only the filler exists in an area between the welded part and the hole.

5. The electric discharge lamp unit according to claim 1, further comprising a cover member which covers at least part of a surface of the filler on the side of the support member, wherein the heat conductivity of the filler is lower than heat conductivity of the cover member.

6. The electric discharge lamp unit according to claim 5, further comprising a welded part for joining components, which are arranged inside the casing, to each other, wherein the cover member has a hole in an area contacting the filler, and only the filler exists in an area between the welded part and the hole.

7. The electric discharge lamp unit according to claim 1, wherein the power circuit and the control circuit are arranged inside a ballast module.

8. The electric discharge lamp unit according to claim 7, wherein the ballast module is disposed immediately adjacent the support member.

9. The electric discharge lamp unit according to claim 7, wherein the power circuit includes an H-bridge circuit, a driver and a boosting circuit.

10. The electric discharge lamp unit according to claim 1, wherein the power circuit includes an H-bridge circuit, a driver and a boosting circuit.

* * * * *